United States Patent [19]

Usami et al.

[11] Patent Number: 4,682,194

[45] Date of Patent: Jul. 21, 1987

[54] HEAT-SENSITIVE RECORDING MATERIAL

[75] Inventors: Toshimasa Usami; Toshiharu Tanaka; Shohei Yoshida, all of Shizuoka, Japan

[73] Assignee: Fuji Photo Film Co., Ltd., Kanagawa, Japan

[21] Appl. No.: 931,093

[22] Filed: Nov. 17, 1986

Related U.S. Application Data

[63] Continuation-in-part of Ser. No. 735,227, May 17, 1985, abandoned.

[30] Foreign Application Priority Data

May 17, 1986 [JP] Japan ..... 59-99490

[51] Int. Cl.[4] ..... B41M 5/18

[52] U.S. Cl. ..... 503/215; 503/213; 503/216; 503/217; 427/150; 427/151; 428/402.21; 428/402.22

[58] Field of Search ..... 346/200, 209, 213–217, 346/226; 427/150–152; 428/402.2–402.22

[56] References Cited

FOREIGN PATENT DOCUMENTS 0045090 3/1983 Japan ..... 346/204

*Primary Examiner*—Bruce H. Hess

*Attorney, Agent, or Firm*—Sughrue, Mion, Zinn, Macpeak, and Seas

[57] ABSTRACT

A heat-sensitive recording material is described, comprising a support comprising thereon a layer containing microcapsules containing a leuco dye and an organic solvent in a core thereof and a color developer outside of said microcapsules capable of reacting with said leuco dye to develop a color, wherein a glass transition point of said microcapsule wall is from about 60° C. to 200° C.

15 Claims, No Drawings

HEAT-SENSITIVE RECORDING MATERIAL

This application is a continuation-in-part application of Ser. No. 735,227, filed May 17, 1985, now abandoned.

FIELD OF THE INVENTION

This invention relates to a heat-sensitive recording material and more particularly to a heat-sensitive recording material with an improved prerecording shelf life and an improved record stability. More particularly, this invention relates to a heat-sensitive recording material having an improved thermal color developing property.

BACKGROUND OF THE INVENTION

The commonest recording materials used in heat-responsive recording systems are leuco dye materials. However, these heat-sensitive recording materials undergo undesirable changes such as erasure or change of color on handling after recording or upon contact with an adhesive tape, diazo copying paper or the like.

To develop a heat-sensitive recording material free of such disadvantages, much research has recently been undertaken to develop diazo type heat-sensitive recording materials. However, as diazo compounds are inherently unstable, the background of the record tends to be stained under various conditions.

Japanese Patent Application (OPI) No. 201743/82 (corresponding to U.S. patent Ser. No. 552,892) (the term "OPI" as used herein refers to a "published unexamined Japanese patent application open to public inspection") teaches a heat-sensitive recording material comprising microcapsules containing a photopolymerizable vinyl compound, a photopolymerization initiator and one color reactant as the nucleus composition, and a mating color reactant outside the microcapsule disposed on the same side of a support. When such a recording material is heated, the color reactant contained in the core of each microcapsule penetrates through the capsule wall or the other color reactant capable of inducing a color reaction penetrates through the wall into the core of the microcapsule. As a result, a color is produced in either case. Therefore, the color can be selectively developed in the heated areas. Thereafter, the recording material is uniformly exposed to light to polymerize the vinyl compound contained in the core to thereby arrest migration of the image forming dye and to prevent development of color in the background area (i.e., the material is fixed).

Another known system is disclosed in Japanese Patent Application (OPI) Nos. 123086/82 and 125092/82 (corresponding to U.S. Pat. No. 4,411,979), for instance, wherein a light-sensitive heat-sensitive recording material containing a diazo compound, a coupling agent, an alkali generating agent and an auxiliary color developing agent is used for thermal recording, followed by irradiation with light so as to decompose the unreacted diazo compound to terminate the color reaction. However, this recording medium may undergo undesirable discoloration (fog) on the shelf prior to exposure due to gradual precoupling.

To avoid this disadvantage, Japanese Patent Application (OPI) No. 190886/84 (corresponding to U.S. patent Ser. No. 600,267) proposes to incorporate in the core of a microcapsule at least one of the diazo compound, coupling agent and auxiliary color developing agent.

The above-mentioned light-fixable heat-sensitive recording material utilizing microcapsules has the advantages of simplicity of recording device, good shelf life, and stability of the image and background of the record but since at least one of the color reactants is isolated by the microcapsule wall, it has the disadvantage of inadequate thermal color development so that it sometimes fails to give a sufficiently intense color in high speed recording using a brief thermal recording signal, i.e., a signal having a short pulse width.

On the other hand, in the example of Japanese Patent Application (OPI) No. 91438/84, in which the composition of the nucleus material using the acid-base dye must be cured by photopolymerization, and even in the case of a non-photopolymerizable core compositioh (i.e., a core component which does not contain both a vinyl compound and a photopolymerization initiator), the above-mentioned isolation of color reactants by the capsule wall before and after printing input results at times in a decrease in color intensity, though the shelf life and record stability are improved.

SUMMARY OF THE INVENTION

It is a first object of this invention to provide a heat-sensitive recording material having an improved prerecording shelf life and improved stability of the recorded image formed.

It is a second object of this invention to provide a heat-sensitive recording material having improved thermal color developing properties.

It is a third object of this invention to provide a heat-sensitive recording material having excellent adaptability in production.

These and other objects of the present invention are accomplished by a heat-sensitive recording material comprising a support comprising thereon a layer containing microcapsules containing a leuco dye and an organic solvent in a core thereof and a color developer outside of said microcapsules capable of reacting with said leuco dye to produce a color, provided on a support, the wall of the microcapsules being of a polymer having a glass transition point ($T_G$) of about 60 to 200° C.

DETAILED DESCRIPTION OF THE INVENTION

Typically, in thermal recording, as the thermal head of a heat-sensitive recording apparatus is only momentarily heated to about 250° C., satisfactory color production cannot be obtained unless the glass transition point ($T_G$) is below about 200° C. If $T_G$ is in excess of about 200° C., color intensity must be increased, for example, by incomplete encapsulization with the disadvantage of increased fog. On the other hand, as the environment adjacent to heat-sensitive paper may be heated to about 60° C., a $T_G$ value of at least about 60° C. is necessary for preventing fog.

The microcapsule according to this invention is unlike the one used in the conventional recording medium, in which the capsule wall is destroyed by heat or pressure to release the reactive component contained in the core and bring it into contact with the reactive compound disposed outside of the microcapsule to produce a color. Instead, in the microcapsule used in the recording material of this invention both the first color reactant contained in the microcapsule core and the second color reactant outside of the core are caused by heating to penetrate through the capsule wall to react with each other. It is known that when a microcapsule wall is formed by a polymerization technique, a completely impermeable membrane is not obtained, but the wall is more or less permeable. This permeability of the microcapsule wall has been understood to permit low molecular substances to pass through it gradually over an extended period of time. It has never been realized, however, that as in the present invention, an almost instantaneous permeation of substances is produced by heating. Accordingly, it is not necessary that the microcapsule wall in this invention be melted by heat.

If the core composition of the microcapsule slurry produced by the method of this invention is removed and the residue heated, the capsule wall will not utterly show signs of melting or softening at temperature of less than 200° C.

The heat-sensitive recording material described above can be used in thermal recording applications and offer excellent shelf lives and record stability, irrespective of which of the two color reactants is contained in the capsule core. However, it has been found that a higher color intensity is realized when the leuco dye compound is incorporated in the core. It has also been found that the previous dissolution of the color reactants in an organic solvent in the broad sense of the term contributes to improved thermal color development and shelf life. In order to achieve a further improved color development, the microcapsule wall has a glass transition point in the range of about 60° C. to 200° C., preferably about 70° C. to 150° C. The very brief heating by the thermal head transforms the microcapsule wall from the glassy state to the rubbery state to permit color reactants to permeate the wall and react with each other as described above. Microscopic examination reveals that mainly the reactant initially located outside the microcapsule penetrates through the wall into the core where it reacts with the core color reactant with the result that the interior of the microcapsule is colored. The glass transition point of the microcapsule according to this invention is the glass transition point of the microcapsule wall influenced by the various substances located outside of the microcapsule. Particularly when a glass transition point modifier outside of the microcapsule is fused and brought into intimate contact with the capsule wall at thermal printer input, a marked depression of glass transition point is observed.

The glass transition point intrinsic to the microcapsule wall can be controlled by varying the material forming the capsule wall. Preferred materials include polyurea, polyurethane and polyurea-polyurethane capsules, urea-formaldehyde capsules, capsules of polyurea and another synthetic resin enclosing a preformed synthetic resin in the core, capsules of polyurethane and another synthetic resin, polyester capsules and polyamide capsules.

The microcapsules in the heat-sensitive recording material according to this invention is produced by emulsifying the nucleus or core material and, then, forming a high polymer wall around the oil droplet. The reactants for forming such a high polymer are added to the inside and/or outside of the oil droplet. Examples of such high polymer include polyurethane, polyurea, polyamide, polyester, polycarbonate, ureaformaldehyde resin, melamine resin, polystyrene, styrenemethacrylate copolymer, styrene-acrylate copolymer or a mixture thereof.

Regarding the method of producing the microcapsule wall of this invention, the microencapsulation technique involving polymerization of the reactants from the inside of the oil droplet is preferred. By this technique, microcapsules suitable for recording materials in terms of particle size uniformity and long shelf life can be obtained.

This technique and specific examples of the compounds have been described in U.S. Pat. Nos. 3,726,804 and 3,796,669.

When polyurea-polyurethane, for instance, is to be used as the capsule wall material, a polyisocyanate and a second substance (e.g., a polyol or polyamine) adapted to react with said polyisocyanate to form a capsule wall are mixed in aqueous medium or an oily liquid to be encapsulated and after an emulsion is prepared, the temperature is increased to induce a polymerization reaction at the interface of the oil droplet, thereby producing the microcapsule wall. In this operation, a low boiling auxiliary solvent having a high solvent action can be used in the oily liquid, although the polyurea is produced even in the absence of the second substance (e.g., a polyol or polyamine).

Examples of a suitable polyisocyanate and mating reactant polyol or polyamine have been described in U.S. Pat. Nos. 3,281,383, 3,773,695 and 3,793,268, Japanese Patent Publication Nos. 40347/73 (corresponding to British Patent No. 1,127,338) and No. 24159/74 (corresponding to U.S. Pat. No. 3,723,363), Japanese Patent Application (OPI) Nos. 80191/73 (corresponding to U.S. Pat. No. 3,838,108) and 84086/73 (corresponding to British Pat. No. 1,416,224), and these compounds can be used in the practice of this invention.

For the purpose of promoting the urethanation reaction, a tin salt or the like can be used.

The glass transition point of the capsule wall can be varied over a wide range by using a suitable combination of polyisocyanate and polyol or polyamine as the first and the second wall forming reactant materials, respectively.

The glass transition point of the system mentioned hereinbefore can be lowered by addition of a glass transition point modifier such as a carbamic acid ester, an aromatic alkoxy compound, an organic sulfonamide compound or a phenol compound. Examples of the carbamic acid ester include ethyl N-phenylcarbamate, benzyl N-phenylcarbamate, phenethyl N-phenylcarbamate, benzyl carbamate, butyl carbamate and isopropyl carbamate.

Examples of the aromatic alkoxy compound include 2-methoxybenzoic acid, 3,5-dimethoxyphenylacetic acid, 2-methoxynaphthalene, 1,3,5-trimethoxybenzene, p-dimethoxybenzene and p-benzyloxymethoxybenzene.

Examples of the organic sulfonamide include p-toluenesulfonamide, o-toluenesulfonamide, benzenesulfonamide, p-toluenesulfonanilide, N-(p-methoxyphenyl)-p-toluenesulfonamide, N-(o-methoxyphenyl)-p-toluenesulfonamide, N-(p-chlorophenyl)-p-toluenesulfonamide, N-(o-chlorophenyl)-p-toluenesulfonamide, N-(p-tolyl)-p-toluenesulfonamide, N-(o-tolyl)-p-toluenesulfonamide, N-(o-hydroxyphenyl)-p-toluenesulfonamide, N-benzyl-p-toluenesulfonamide, N-(2-phenethyl)-p-toluenesulfonamide, N-(2-hydroxyethyl)-p-toluenesulfonamide, N-(3-methoxypropyl)-p-toluenesulfonamide, methanesulfonanilide, N-(p-tolyl)-sulfonamide, N-(o-tolyl)sulfonamide, N-(p-methoxyphenyl)sulfonamide, N-(o-methoxy)sulfonamide, N-(p-chlorophenyl)sulfonamide, N-(o-chlorophenyl)-sulfonamide, N-(2,4-xylyl)sulfonamide, N-(p-ethoxyphenyl)sulfonamide, N-benzylmethanesulfonamide, N-

(2-phenoxyethyl)methanesulfonamide, 1,3-bis(methanesulfonylamino)benzene and 1,3-bis(p-toluenesulfonylamino)propane.

Examples of the phenol compound include p-t-butylphenol, p-t-octylphenol, p-α-cumylphenol, p-t-pentylphenol, m-xylenol, 2,5-dimethylphenol, 2,4,5-trimethylphenol, 3-methyl-4-isopropylphenol, p-benzylphenol, o-cyclohexylphenol, p-(diphenylmethyl)-phenol, p-(α,α-diphenylethyl)phenol, o-phenylphenol, ethyl p-hydroxybenzoate, propyl p-hydroxybenzoate, butyl p-hydroxybenzoate, benzyl p-hydroxybenzoate, p-methoxyphenol, p-butoxyphenol, p-heptyloxyphenol, p-benzyloxyphenol, dimethyl 3-hydroxyphthalate, vanillin, 1,1-bis(4-hydroxyphenyl)dodecane, 1,1-bis-(4-hydroxyphenyl)-2-ethylhexane, 1,1-bis(4-hydroxyphenyl)-2-methylpentane, 2,2-bis(4-hydroxyphenyl)-heptane, 2-t-butyl-4-methoxyphenol, 2,6-dimethoxyphenol, 2,2'-dihydroxy-4-methoxybenzophenone. Though it is known that a phenol compound is used as a color developer for a leuco dye, above described phenol compounds have comparatively low color development property. Then the combined used of above described phenol compounds and other color developers is preferred.

The glass transition point modifier can be dispersed together with a water-soluble high polymer or the like to a particle size of about 0.4 to 3 μm, preferably about 0.4 to 2 μm and added to the heat-sensitive layer dope or incorporated in the oil droplets of the core material emulsion prior to microencapsulation. The latter procedure is preferred because the required level of addition may be smaller. The amount of glass transition point modifier used may range from about 0.01 to 10 g/m$^2$, preferably from about 0.1 to 6 g/m$^2$.

The glass transition point referred to above is determined by mesuring the Tan δ peak temperature of the capsule wall br the interaction product of capsule wall and glass transition point modifier disposed outside of the capsule by means of a vibron (DDV-III, built by Toyo Baldwin Co., Ltd.) and is the loss elastic modulus divided by the storage elastic modulus. The capsule wall or capsule wall interaction product for use in the determination of glass transition point may be prepared, for example, by the following procedure.

In 30 parts of ethyl acetate is dissolved 20 parts of the capsule wall material xylylene diisocyanate/trimethylolpropane (3/1 in molar ratio) adduct and the solution was bar coated, on a polyethylene sheet. The coated sheet is put in water at 40 to 60° C. for about 5 hours and the film is peeled off and allowed to dry in the air at 24° C. and 64% R.H. for a day, whereby a polyurea film from 10 to 20 μm in thickness is obtained. This film is used as a sample for determination of the inherent glass transition point of the capsule wall as such. A sample of the above-mentioned interaction product of capsule wall and heat fusible material is prepared by the following procedure. The above polyurea film is immersed in a 20% methanolic solution of p-benzyloxyphenol for 30 hours and, then, allowed to dry in the air at 24° C. and 64% R.H. for a day. This product is used as a sample.

A water-soluble high polymer can be used as a protective colloid in the preparation of microcapsules. The term "water-soluble high polymer" as used herein includes water-soluble anionic high polymers, nonionic high polymers and amphoteric high polymers. The anionic high polymers may be naturally occurring or synthetic polymers and those containing —COO—, —$SO_3$— or a similar group may be employed. Examples of naturally occurring anionic high polymers include gum arabic and alginic acid, and examples of semisynthetic anionic high polymers include carboxymethyl cellulose, phthalated gelatin, sulfated starch, sulfated cellulose and lignin-sulfonic acid. Examples of synthetic anionic high polymers include maleic anhydride (inclusive of hydrolyzate) copolymers, acrylic (and methacrylic) acid polymers and copolymers, vinylbenzenesulfonic acid polymers and copolymers and carboxyl-modified polyvinyl alcohol.

The nonionic high polymers mentioned above include polyvinyl alcohol, hydroxymethyl cellulose and methyl cellulose. The amphoteric high polymer is exemplified by gelatin and the like.

The above-mentioned water-soluble high polymer is used in the form of a 0.01 to 10 weight percent aqueous solution.

With regard to the organic solvent used in the practice of this invention, if it is too low boiling, a loss due to evaporation will take place during storage on the shelf. Therefore, it is preferable to use a solvent having a boiling point of at least about 180° C. Suitable solvents which will not be involved in vinyl polymerization include phosphoric acid esters, phthalic acid esters and other carboxylic acid esters, fatty acid amides, alkylated biphenyl, alkylated terphenyl, chlorinated paraffin, alkylnaphthalenes and diarylethanes. Specific examples include tricresyl phosphate, trioctyl phosphate, octyldiphenyl phosphate, tricyclohexyl phosphate, dibutyl phthalate, dioctyl phthalate, dilaurate phthalate, dicyclohexyl phthalate, butyl oleate, diethylene glycol dibenzoate, dioctyl sebacate, dibutyl sebacate, dioctyl adipate, trioctyl trimellitate, acetyltriethyl citrate, octyl maleate, dibutyl maleate, isopropylbiphenyl, isoamylbiphenyl, chlorinated paraffin, diisopropylnaphthalene, 1,1'-ditolylethane, 2,4-di-tertamylphenol and N,N-dibutyl-2-butoxy-5-tert-octylaniline. A vinyl compound may be used as the organic solvent.

The leuco dyes that can be incorporated in the heat-sensitive recording material according to this invention are dyes which donate electrons or accept acid or other protons to produce colored substances. The leuco dyes are usually substantially colorless, and have a partial skeletal structure, such as a lactone, lactam, sultone, spiropyran, ester or amide structure, which undergoes cleavage or fission (ring opening reaction) on contact with a color developer. Specific examples of such compounds include crystal violet lactone, benzoyl leuco methylene blue, malachite green lactone, rhodamine β-lactam and 1,3,3-trimethyl-6'-ethyl-8'-butoxyindolinobenzospiropyran.

Examples of the color developer for the above-mentioned dyes include phenol compounds, organic acids or metal salts thereof, and hydroxybenzoic acid esters.

Preferred color developers are phenol compounds and organic acids which melt at about 50 to 250° C., preferably about 60 to 200° C., and are sparingly soluble in water.

Examples of phenol compounds include 4,4'-isopropylidene-diphenol (bisphenol A), p-tert-butylphenol, 2,4-dinitrophenol, 3,4-dichlorophenol, 4,4'-methylenebis-(2,6-di-tert-butylphenol), p-phenylphenol, 4,4-cyclohexylidenediphenol, 2,2'-methylenebis(4-tert-butylphenol), 2,2'-methylenebis(α-phenyl-p-cresol)thiodiphenol, 4,4'-thiobis(6-tert-butyl-m-cresol), sulfonyldiphenol, 1,1-bis(4-hydroxyphenyl)-n-dodecane, 4,4-bis(4-hydroxyphenyl)-1-pentanoate, p-tert-butylphenol-formaldehyde condensate and p-phenylphenol-formaldehyde condensate.

Useful examples of organic acids and metal salts thereof include 3-tert-butylsalicylic acid, 3,5-tert-butylsalicylic acid, 5-α-methylbenzylsalicylic acid, 3,5-di-α-methylbenzylsalicylic acid, 3-tertoctylsalicylic acid, 5-α-,γ-dimethyl-α-phenyl-γ-phenylpropylsalicylic acid and salts thereof of zinc, lead, aluminum, magnesium or nickel.

The hydroxybenzoic acid esters mentioned above include, among others, ethyl p-hydroxybenzoate, butyl p-hydroxybenzoate, heptyl p-hydroxybenzoate, and benzyl p-hydroxybenzoate. These compounds are used after being dispersed in solid state using a water-soluble polymer as protective colloid by means of a sand mill or the like.

The amounts of the foregoing compounds present per unit area ($m^2$) are as follows: the leuco dye from about 0.05 to 1.5 g, preferably from about 0.05 to 0.4 g; and the color developer from about 0.5 to 8 g, preferably from about 0.5 to 4 g.

The heat-sensitive recording material according to this invention may also contain conventional additives to prevent sticking to the thermal head or to ensure improved printing qualities, such as silica, barium sulfate, titanium oxide, aluminum hydroxide, zinc oxide, calcium carbonate and other pigments, polystyrene beads and comminuted urea-melamine resin.

For the purpose of imparting such antitack properties, metal soaps can also be employed. The level of addition of such additives is about 0.2 to 7 g/$m^2$, preferably about 0.2 to 2 g/$m^2$.

The heat-sensitive recording material of this invention can be formulated into a coating dope with the aid of a suitable binder vehicle, for instance, polyvinyl alcohol, methyl cellulose, carboxymethyl cellulose, hydroxypropyl cellulose, gum arabic, gelatin, polyvinylpyrrolidone, casein, styrene-butadiene copolymer latex, acrylonitrile-butadiene copolymer latex, polyvinyl acetate, polyacrylates, ethylene-vinyl acetate copolymer and various other polymer emulsions. The amount of such vehicles is about 0.5 to 5 g (as nonvolatile matter)/$m^2$, preferably about 0.5 to 3 g/$m^2$.

In the practice of this invention, acid stabilizers such as citric acid, tartaric acid, oxalic acid, boric acid, phosphoric acid, pyrophosphoric acid, etc., can be added in addition to the above-mentioned agents and additives.

The heat-sensitive recording material according to the invention can be manufactured by the following procedures. Microcapsules containing a leuco dye as one of the color reactants are mixed with a color developer as the second color reactant in solid state or the two reactants are dissolved in water and mixed to prepare a coating dope, which is then spread on a support such as paper or synthetic resin film by a suitable technique such as bar boating, blade coating, air knife coating, gravure coating, roll coating, spray coating or dip coating to give a heat-sensitive layer with a nonvolatile matter content of about 2.5 to 25 g/$m^2$.

As the paper for the support, a neutral paper with a thermal extract pH of about 6 to 9 as sized with a neutral sizing agent such as an alkyl-ketene dimer is advantageous in terms of aging resistance (e.g., as described in Japanese Patent Application (OPI) No. 14281/80).

To prevent penetration of the coating dope into the substance of paper and ensure improved contact of the heat-sensitive recording layer with the thermal head, it is advantageous to employ paper satisfying the relation $$\frac{\text{Stöckigt sizing degree}}{(\text{meter basis weight})^2} \geqq 3 \times 10^{-3}$$

and having a Bekk smoothness of at least 90 seconds as taught in Japanese Patent Application (OPI) No. 116687/82.

Also useful is the paper with an optical surface roughness of about 8 μm or less and a thickness of about 40 to 75 μm described in Japanese patent application (OPI) No. 136492/83, the paper with a density of about 0.9 g/$cm^3$ or less and an optical contact rate of at least about 15% described in Japanese Patent Application (OPI) No. 69091/83 (corresponding to U.S. patent application Ser. No. 436,083), the paper manufactured from a pulp beaten to a Canadian Standard Freeness (JIS P-8121) of at least about 400 cc and strike-through-proofed as described in Japanese Patent Application (OPI) No. 69097/83 (corresponding to U.S. patent application Ser. No. 435,803), the paper manufactured using a Yankee machine, the glossy side of which is coated to attain improved image color density and resolution as taught in Japanese Patent Application (OPI) No. 65695/83 (corresponding to U.S. Pat. No. 4,466,007), and the paper treated by corona discharge for improving coating effect as described in Japanese Patent application (OPI) No. 35985/84.

All of these and other supports used in the conventional heat-sensitive recording materials can be utilized in the practice of this invention.

The heat-sensitive recording material of this invention has a very satisfactory pre-recording shelf life and an excellent thermal color developing property. Moreover, the heat-sensitive recording material can each be used as an element in the multicolor heat-sensitive recording sheet.

This invention will hereinafter be described in further detail by reference to specific examples, but these examples are not to be construed as limiting the scope of the invention. In the examples, all parts, percents and ratios are by weight, unless otherwise indicated.

EXAMPLE

Heat-Sensitive Recording Material A

In a solvent mixture of 24 parts of diisopropylnaphthalene and 5 parts of ethyl acetate were dissolved 2 parts of the leuco dye shown below and 18 parts of xylylene diisocyanate-trimethylolpropane adduct (3/1 in molar ratio). This leuco dye solution was mixed with a solution of 3.5 parts of polyvinyl alcohol (molecular weight: about 76,000), 1.7 parts of gelatin and 2.4 parts of 1,4-di(hydroxyethoxy)benzene in 58 parts of water and the mixture was dispersed and emulsified at 20° C. to give an emulsion with an average particle diameter of 3 μm. To this emulsion was added 100 parts of water and the mixture was heated at 60° C. with stirring for 2 hours, whereby a slurry of microcapsules having a diameter of about 3 μm each containing the leuco dye in the core was obtained.

Leuco Dye

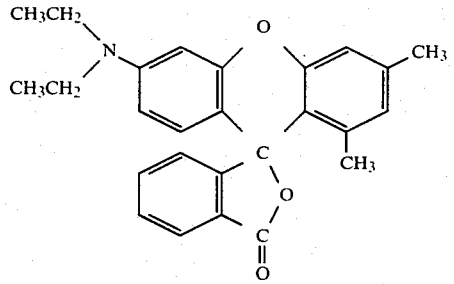

Then, 20 parts of bisphenol A was added to 100 parts of a 5% aqueous solution of polyvinyl alcohol (molecular weight: about 76,000) and dispersed by means of a sand mill for about 24 hours to give a bisphenol A dispersion with an average particle diameter of 3 μm.

A coating dope was prepared by mixing 5 parts of the microcapsule slurry with 3 parts of the bisphenol A dispersion.

The above dope was spread on smooth wood-free paper (50 g/m$^2$) in a coverage of 7 g/m$^2$ (dry) and dried at 40° C. for 30 minutes to give a heat-sensitive recording material. The glass transition point of the microcapsules was 110° to 130° C.

Heat-Sensitive Recording Material B

The production procedure for heat-sensitive recording material A was followed, except that 6 parts of tolylene diisocyanate-trimethylolpropane adduct (3/1 in molar ratio) was used instead of 18 parts of xylylene diisocyanate-trimethylolpropane adduct (3/1 in molar ratio), and 2.4 parts of 1,4-di(hydroxyethoxy)benzene was removed from the aqueous phase composition. Otherwise, the same procedure for A was repeated. The glass transition point of the resulting microcapsules was 150° to 160° C.

Heat-Sensitive Recording Material C

The production procedure for heat-sensitive recording material A was followed, except that gelatin and 1,4-di(hydroxyethoxy)benzene was removed from the aqueous phase composition to prepare a slurry of microcapsules. Otherwise, 10 parts of bisphenol A and 20 parts of p-benzyloxyphenol were used instead of 20 parts of bisphenol A to prepare a dispersion.

A coating dope was prepared by mixing 4-parts of the microcapsule slurry with 5 parts of bisphenol A/p-benzyloxyphenol dispersion.

The above dope was spread on paper support in a coverage of 10 g/m$^2$ (on a solid basis). The glass transition point of the microcapsules as a system was 115° to 125° C.

Heat-Sensitive Recording Material D

The production procedure for heat-sensitive recording material A was followed, except that 1 g of p-benzyloxyphenol was further added to the solvent mixture of 24 parts of diisopropylnaphthalene and 5 parts of ethyl acetate. The glass transition point of microcapsules which were plasticized by p-benzyloxyphenol was 60° to 65° C.

Heat-Sensitive Recording Material E

The production procedure for heat-sensitive recording material A was followed, except that 1.7 parts of gelatin and 2.4 parts of 1,4-di(hydroxyethoxy)-benzene were removed, and furthermore 9 parts of xylylene diisocyanate-trimethylolpropane adduct (3/1 in molar ratio) and 9 parts of polymethylenepolyphenylisocyanate were used instead of 18 parts of xylylene diisocyanatetrimethylolpropane adduct (3/1 in molar ratio). The glass transition point of microcapsules was 190° to 200° C.

Heat-Sensitive Recording Material F

The production procedure for heat-sensitive recording material C was followed, except that the microcapsule prepared for the heat-sensitive recording material A was used instead of the microcapsule prepared for the heat-sensitive recording material C.

The glass transition point of the microcapsules as a system influenced by p-benzyloxyphenol (glass transition point modifier) was 85° to 95° C.

Heat-Sensitive Recording Material G

The production procedure for heat-sensitive recording material A was followed, except that 10 parts of bisphenol A and 10 parts of p-hydroxybenzoic acid were used instead of 20 parts of bisphenol A.

The glass transition point of the microcapsules as a system influenced by p-hydroxybenzoic acid was 70° to 80° C.

CONTROL EXAMPLE

Heat-Sensitive Recording Material H

To prepare the microcapsule for heat-sensitive recording material H, the production procedure for heat-sensitive recording material A was followed, except that 12 parts of hexamethylene diisocyanate-trimethylolpropane adduct and 6 parts of xylylene diisocyanate-trimethylolpropane adduct were used instead of 18 parts of xylylene diisocyanatetrimethylolpropane adduct (3/1 in molar ratio).

Otherwise, the same procedure for heat-sensitive recording material C was repeated except fcr using the above-prepared microcapsule.

The glass transition point of the microcapsules as a system was 50° to 55° C.

Heat-Sensitive Recording Material I

The production procedure for heat-sensitive recording material A was followed, except that 9 parts of polymethylenepolyphenylisocyanate and 9 parts of xylylene diisocyanatetrimethylol propane adduct were used instead of 18 parts of xylylene diisocyanate-trimethylolpropane adduct (3/1 in molar ratio), and 1.7 parts of gelatin and 2.4 parts of 1,4-di(hydroxyethyloxy)benzene were removed, and furthermore 20 parts of bisphenol S was used instead of 20 parts of bisphenol A.

The glass transition point of the microcapsules as a system was 210° to 220° C.

Heat-Sensitive Recording Material J

In 95 parts of hot water at about 80° C. was dissolved 5 parts of partial sodium salt of polyvinylbenzenesulfonic acid (National Starch, VERSA, TL500, average molecular weight 500,000) with stirring in about 30 minutes, followed by cooling. The resulting aqueous solution having a pH of 2 to 3 was adjusted to pH 4.0 with a 20 wt% aqueous solution of sodium hydroxide.

Separately, 4 parts of the same leuco dye as that used in heat-sensitive recording material A was dissolved in a mixture of 100 parts of diisopropylnaphthalene and 25 parts of ethyl acetate with heating to 70° C. and the resulting hydrophobic solution was dispersed in 100 parts of a 5% aqueous solution of the partial sodium salt of polyvinylbenzenesulfonic acid to give an emulsion with an average particle diameter of 4.5 μm. Separately, 6 parts of melamine, 11 parts of a 37 wt% aqueous solution of formaldehyde and 83 parts of water were mixed by stirring at 60° C. for 30 minutes to give a clear mixed aqueous solution of melamine, formaldehyde and melamine-formaldehyde precondensate. This mixed aqueous solution had a pH value of 6 to 8.

The precondensate solution was mixed with the emulsion and under stirring the pH of the mixture was adjusted to pH 6.0 with a 20 wt% solution of acetic acid. The liquid temperature was then increased to 65° C. whereby microcapsules having a diameter of about 3 μm were formed. This microcapsule slurry was cooled to room temperature and its pH was adjusted to pH 9.0 with a 20 wt% solution of sodium hydroxide. To remove the residues of formaldehyde, after 60 minutes of encapsulation reaction at 65° C., the system was adjusted to pH 4.0 with 1 N hydrochloric acid and 30 parts of a 40 wt% aqueous solution of urea was added. The stirring was continued at a constant temperature of 65° C. for 40 minutes, after which the system was adjusted to pH 9.0 with a 20 wt% aqueous solution of sodium hydroxide.

A coating dope was prepared by mixing 4.5 parts of the above microcapsule slurry with 3 parts of the bisphenol A dispersion and 0.5 part of water.

The above coating dope was spread on smooth wood-free paper (50 g/m$^2$) in a coverage of 7 g/m$^2$ (dry) and dried at 40° C. for 30 minutes to give a heat-sensitive recording material. The glass transition point of the microcapsules was more than 200° C.

Heat-Sensitive Recording Material K

To 100 parts of a 5% aqueous solution of polyvinyl alcohol (molecular weight: about 76,000) was added 20 parts of the same leuco dye as used in heat-sensitive recording material A and the mixture was dispersed by means of a sand mill for about 24 hours to give a leuco dye dispersion with an average particle diameter of 3 μm.

A coating dope was prepared by mixing 0.6 part of the above leuco dye dispersion with 3 parts of the bisphenol A dispersion.

The dope thus prepared was spread on smooth wood-free paper (50 g/m$^2$) to give a dry coating weight of 4.5 g/m$^2$ and dried at 40° C. for 30 minutes to give a heat-sensitive recording material.

Thermal recordings were made on the above heat-sensitive recording materials A through K using a GII mode printer (Pana Fax 7200).

To investigate the shelf life of the heat-sensitive recording material, samples used in accelerated aging test at 40° C. and 90% R.H. for 1 day were also thermally printed in the same manner as above. Moreover, to investigate the resistance of the recording material upon contact with a diazo paper after copying, the material was held in contact with a diazo paper immediately following the copying for 3 hours and any increase in fog in the background was evaluated. The results are shown in Table 1.

TABLE 1

| Heat-Sensitive Recording Material | Glass Transition Point of Capsule Wall | Test Results | | | |
|---|---|---|---|---|---|
| | | Fog | Intensity of Color | Fog after Accelerated Test | Contact Fog (diazo paper) |
| A (Invention) | 110–130° C. | 0.08 | 1.22 | 0.13 | o |
| B (Invention) | 150–160° C. | 0.06 | 1.11 | 0.10 | o |
| C (Invention) | 115–125° C. | 0.07 | 1.31 | 0.11 | o |
| D (Invention) | 60–65° C. | 0.15 | 1.25 | 0.21 | o |
| E (Invention) | 190–200° C. | 0.06 | 1.00 | 0.10 | o |
| F (Invention) | 85–95° C. | 0.10 | 1.21 | 0.15 | o |
| G (Invention) | 70–80° C. | 0.12 | 1.25 | 0.16 | o |
| H (Control) | 50–55° C. | 0.21 | 1.25 | 0.59 | o |
| I (Control) | 210–220° C. | 0.06 | 0.85 | 0.07 | o |
| J (Control) | >200° C. | 0.06 | 0.11 | 0.07 | o |
| K (Control) | — | 0.21 | 1.23 | 0.41 | x |

It will be apparent from Table 1 that the heat-sensitive recording materials A, B, C, D, E, F and G according to this invention have the advantages of reduced fog, high color intensity, good shelf life and reduced diazo paper contact fog. Heat-sensitive recording material J of high glass transition point has the advantage of reduced fog, but it has the disadvantage of low color density. Heat-sensitive recording material K of being non-capsulated has the advantage of high color intensity, but it has the disadvantages of high color intensity and reduced diazo paper contact fog.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support and a recording layer comprising microcapsules containing a leuco dye and an organic solvent in a core thereof and a color developer outside of said microcapsules capable of reacting with said leuco dye to produce a color, said microcapsules having walls being of a polymer having a glass transition point of from about 60° C. to 200° C.

2. A heat-sensitive recording material as in claim 1, wherein said glass transition point is from about 70° C. to 150° C.

3. A heat-sensitive recording material as in claim 1, wherein said microcapsule further contains a glass transition point modifier.

4. A heat-sensitive recording material as in claim 3, wherein a glass transition modifier is a carbamic acid ester, an aromatic methoxy compound or an organic sulfonamide compound.

5. A heat-sensitive recording material as in claim 3, wherein said glass transition point modifier is a phenol compound.

6. A heat-sensitive recording material as in claim 5, wherein said glass transition point modifier is p-benzyloxyphenol.

7. A heat-sensitive recording material as in claim 6, wherein said microcapsule wall being of a polymer is polyurethane, polyurea or a mixuture thereof.

8. A heat-sensitive recording material as in claim 1, wherein said leuco dye has a partial skeletal structure, which undergoes cleavage or fission on contact with a color developer.

9. A heat-sensitive recording material as in claim 8, wherein said leuco dye has a partial skeletal structure of a lactone, a lactam, a sultone, a spiropyran, an ester or an amide.

10. A heat-sensitive recording material as in claim 1, wherein said color developer is a phenol compound, an organic acid or metal salts thereof, or a hydroxybenzoic acid ester.

11. A heat-sensitive recording material as in claim 10, wherein said phenol compound and an organic acid is melt at about 50° C. to 250° C.

12. A heat-sensitive recording material as in claim 1, wherein said organic solvent has a boiling point of at least about 180° C.

13. A heat-sensitive recording material as in claim 1, wherein said recording layer has a non-volatile matter content of from about 2.5 to 25 $g/m^2$.

14. A heat-sensitive recording material as in claim 1, wherein said microcapsule wall being of a polymer is polyurethane, polyurea, polyamide, polyester, ureaformaldehyde resin or a mixture thereof.

15. A heat-sensitive recording material as in claim 1, wherein said microcapsule wall being of a polymer is polyurethane, polyurea or a mixture thereof.

* * * * *